United States Patent [19]

Wolfe, III

[11] Patent Number: 5,044,285

[45] Date of Patent: Sep. 3, 1991

[54] SHELF AND BRACKET COMBINATION

[76] Inventor: Russell Wolfe, III, 32 Moore Ave., Nashville, Tenn. 37210

[21] Appl. No.: 568,423

[22] Filed: Aug. 16, 1990

[51] Int. Cl.[5] ..... A47B 3/06

[52] U.S. Cl. ..... 108/152; 211/90

[58] Field of Search ..... 211/90, 94, 87; 312/245; 108/152, 153, 42; 248/225.2, 220.1

[56] References Cited

U.S. PATENT DOCUMENTS

| | | | |
|---|---|---|---|
| 2,219,975 | 10/1940 | Bentz | 211/90 |
| 3,033,507 | 5/1963 | Brill | 312/245 |
| 3,101,486 | 8/1963 | Tiller | 108/152 |
| 3,117,353 | 1/1964 | Edwards | 248/225.2 |
| 3,190,243 | 6/1965 | Pira | 108/152 |
| 3,311,435 | 3/1967 | Heritage | 312/245 |
| 3,381,636 | 5/1968 | Saiberlich | 108/152 |
| 3,669,035 | 6/1972 | Grossman | 108/152 |
| 3,718,101 | 2/1973 | Sacks | 108/152 |
| 4,843,977 | 7/1989 | Bridges | 211/90 |

*Primary Examiner*—Kenneth J. Dorner
*Assistant Examiner*—Gerald A. Anderson
*Attorney, Agent, or Firm*—I. C. Waddey, Jr.

[57] ABSTRACT

A shelf is disclosed which can be used to display artifacts and objects d'art in which the shelf not only serves the utilitarian function of providing a place on which to set the item being displayed, but which becomes a part of a display and can be a decorative object d'art itself. The shelf can also serve as a bracket on which to mount a larger shelf. The shelf itself is three dimensional having a thickness of a minimum of two inches. The shelf has a primary surface, or top, and secondary surface, or bottom. The primary surface is connected to and spaced from the secondary surface by a facing surface and a mounting surface. The primary surface, secondary surface, and the facing surface are generally finished with the same material, either painted or veneered. The mounting surface is flat and has a rectangular opening into a mounting cavity formed by the spaced relationship of the primary surface, secondary surface, and facing surface. Within the mounting cavity is a mounting tooth protruding from at least two sides of the rectangular opening. The mounting tooth is spaced inwardly of the cavity from the mounting surface and within a plane generally parallel to the plane of the mounting surface. A mounting bracket, to be affixed to a wall, has a support arm spaced from the base and creating a channel along the bracket into which the mounting tooth will fit.

11 Claims, 4 Drawing Sheets

SHELF AND BRACKET COMBINATION

BACKGROUND OF THE INVENTION

My invention relates to the art of shelving. A shelf has been generally defined as a thin, flat, usually long and narrow, piece of wood or other material fastened horizontally (as on a wall) to hold objects. A shelf can also be a form such as a flat projecting layer of rock.

Shelves are generally readily recognizable. They are shelves and nothing more. They normally have visible means of support and a visible mounting structure. Most known mounting structures are very difficult to install and once installed, can not be moved in order to adjust the relationship between one shelf and another. There has been limited effort at developing a shelf structure which is unique in appearance, which serves both a functional and a decorative purpose, which completely hides its mounting structure, which is strong and steady in its connection to a wall or other mounting surface, and which can be adjusted from side to side. Side to side adjustability is significant because it allows one to arrange one shelf in relationship to another or a shelf in relationship to some other object without having to remove the mounting, relocate the mounting and repair the attendant marring of the mounting wall as a result of having to move the shelf from one location to another.

Shelves are used to display personal items in the home and office as well as for display purposes in retail and wholesale product outlets. Particularly in the retail marketplace, it would be desirable to have a shelving system which could be easily adjusted, easily interchanged with other shelving shapes, colors, and forms and which would be steady and secure in the support of the object being displayed. It is also desirable in such a shelving structure to have a shelf that can serve as a bracket on which to mount another shelf of greater dimension and capacity. Many times it would be desirable to reorient the direction of the shelf, to invert the shelf, or rotate it by 90 degrees in order to create a different visual impression for the display being exhibited on the shelf. Such a system would be most desirable in the retail marketing industry and yet has not been readily available in a style and at a cost that is practical. This invention helps to overcome these shortcomings in the shelving art.

PRIOR ART

In a limited fashion, the inventions of the prior art have attempted to meet some of the objectives of the present invention. However, these efforts have failed to produce a shelving system which meets the multiple and varying objectives of the present invention, particularly when considering the difficulty in construction of the prior art shelving as opposed to the simplicity of the present device. Prior art which is known to the inventor that is most significant in considering the present invention would include the patent to Saiberlich, U.S. Pat. No. 3,381,636. Saiberlich attempts to provide a shelf which mounts to a vertical wall with no visible means of support and which eliminates the usual metal brackets and the like required for supporting wall mounted shelves. Saiberlich fails, however, to provide a shelf that can be mounted with different orientations, i.e., a shelf that can be mounted at any one of four 90 degree rotated positions. Moreover, even with Saiberlich's invention, the lower side of the mounting bracket can be seen if the shelf is mounted at a height above the observer's eye and the mounting structure can be seen from the end of the shelf. Further, Saiberlich fails to have a structure which would bias the shelf to the wall and thereby produce a cleaner edge of connection between the shelf and the wall.

The patent to Grossman, U.S. Pat. No. 3,669,035 shows a mounting structure similar to Saiberlich, and in FIG. 4 shows a mounting structure which hides the structure from the ready vision of the observer. On the other hand, the ends of the mounting structure can be readily seen and are not encapsulated, and the shelf can not be mounted at different orientations. The shelf can not be used as a bracket or used to support other shelf type structures, nor can it be rotated about its axis and mounted at varying relative positions.

The patent to Pira, U.S. Pat. No. 3,190,243 illustrates a shelf which encapsulates the mounting bracket, but this shelf is designed to be mounted on a wall panel or pegboard type structure and the mounting brackets are such that the shelf can not be oriented in different directions on the pegboard.

The patent to Sacks, U.S. Pat. No. 3, 718,101 shows a mounting structure that will allow the shelf to be mounted at different orientations, but the shelf it self can not be originally attached to the mounting bracket in a fashion to be biased against the vertical wall.

SUMMARY OF INVENTION

My invention is a shelf which can be used as a shelf or as a bracket and which can be easily mounted to the wall and yet have its position on the wall adjusted through the mounting structure. The shelf has a top surface and a bottom surface, facing and mounting surfaces which connect the top surface and the bottom surface, and the mounting surface has a rectangular opening which provides access to a mounting cavity within the shelf. Protruding into the mounting cavity from each of the four sides of the rectangular opening is a tooth which works in cooperation with the mounting bracket to connect the shelf to a wall and firmly secure the shelf to and bias it against the wall. The mounting bracket has a support arm which is designed to create a channel between the mounting bracket and the support arm. The support arm is biased at an approximately 2 degree angle toward the mounting bracket to create a snug fit between the shelf and the wall.

Having described generally the shelf of my invention, it is a primary object of this invention to provide a shelf that can be used both as a shelf and as a bracket on which to mount or position a larger shelf. It is a further object of this invention to provide a shelf with no visible means of attachment.

It is a further object of this invention to provide a shelf which can be mounted in one of several positions and can be rotated about its mounting structure to be oriented in one of several various directions. It is a further object of this invention to provide a shelf which can be adjusted from side to side in order to place the shelf on a wall in exact relationship to other shelves or other objects and yet will still encapsulate the mounting bracket or mounting structure so that the same will not be visible to one viewing the shelf. It is a further object of this invention to provide a shelf that is easily removed from the wall, thus enabling both the color and shape of the shelf to be changed as frequently as needed to display and market items in retail and wholesale establishments.

It is a further object of this invention to provide a shelf that is easily adjusted for the irregularities in a surface to which it is being attached. It is further an object of this invention to provide a shelf which can be mounted with no visible means of support and which can be easily constructed and manufactured at a minimum cost and expense. It is a further object of this invention to provide a shelf which can be constructed in multiple shapes and sizes in order to become a part of the display system rather than simply a support for a display system.

THE DRAWINGS

With the foregoing and other objects of the invention in mind, a preferred embodiment of the invention will now be described in conjunction with the attached drawings in which like parts are identified by like reference numerals and in which.

Figure 1:
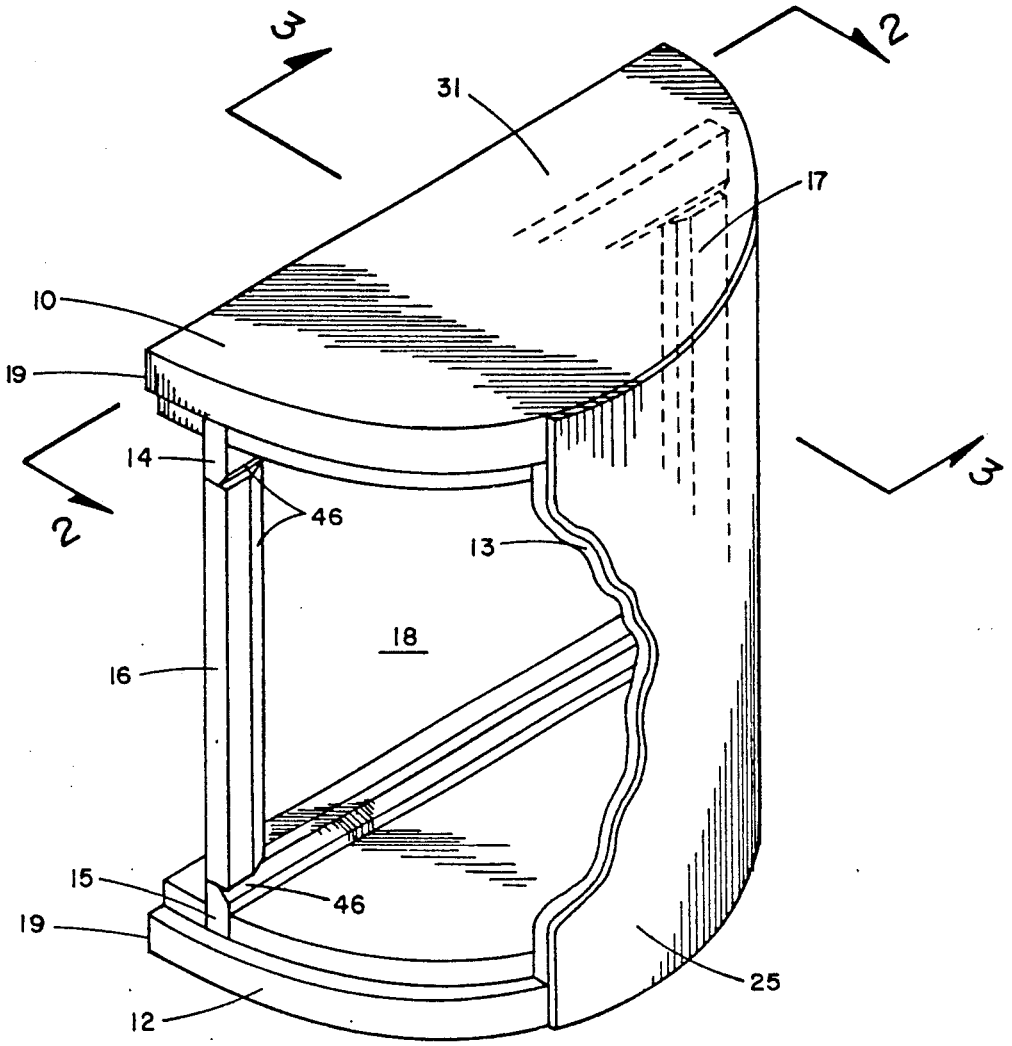
FIG 1 shows a prospective view of a cut-away of the shelf unit itself.

As can be seen from FIG. 1, the preferred embodiment of this invention is a shelf constructed of support block 10 and support block 12 which are aligned parallel to each other in spaced relationships. The support block 10 and support block 12 are connected in spaced relationship by the bender board 13 and a framework consisting of mounting tooth 14, mounting tooth 15, mounting tooth 16, and mounting tooth 17. Mounting tooth 14 protrudes from support block 10 and mounting tooth 15 protrudes from support block 12; mounting tooth 14 and mounting tooth 15 being connected at their opposing ends by mounting tooth 16 and mounting tooth 17. The connection of mounting tooth 14, mounting tooth 15, mounting tooth 16, and mounting tooth 17 forms a rectangular opening which gives access to the mounting cavity 18 created by the spatial relationship between support block 10, support block 12, and bender board 13.

Figure 2:
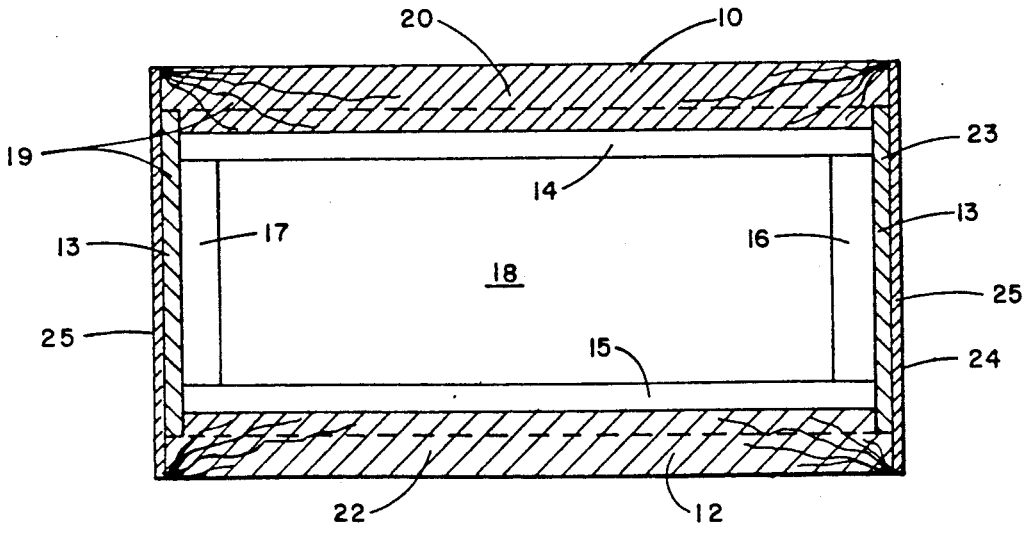
FIG. 2 shows a plain view of the shelf taken along the line 2—2 of FIG. 1.
Figure 3:
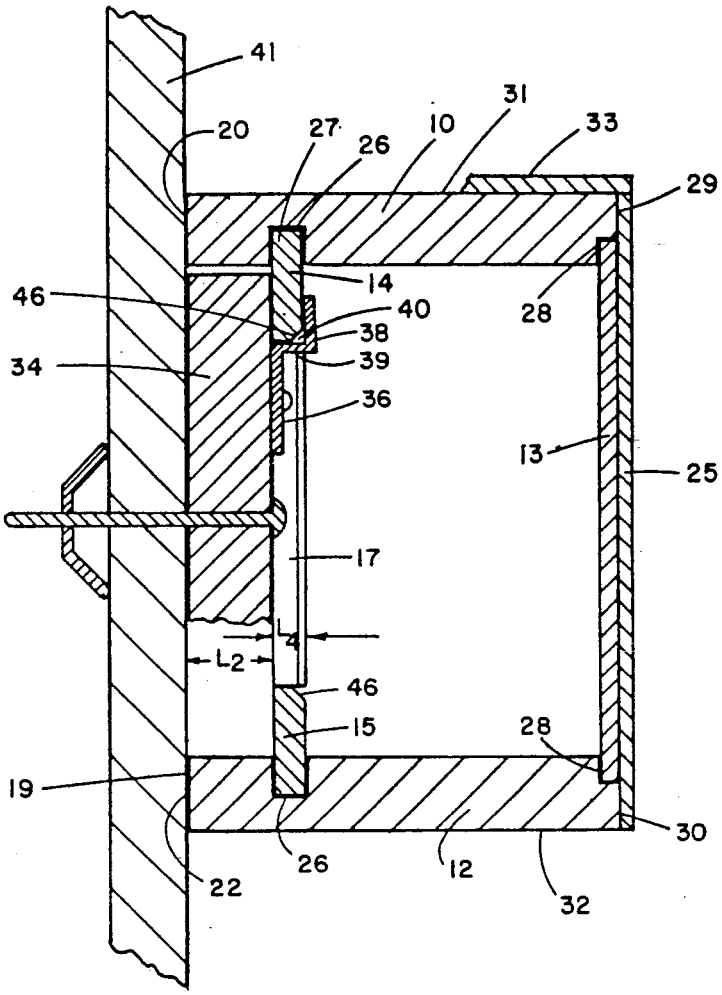
FIG. 3 shows a sectional view of the shelf taken along the line 3—3 of FIG. 1.

The shelf has a mounting surface 19 which lies within a single plane. As can be seen from FIG. 2, the mounting surface 19 is formed by the face 20 of the upper support block 10 and the face 22 of the lower support block 12, along with face 23 of the bender board 13 as well as the face 24 of the veneer 25 in those cases where a veneer covers the bender board 13 (see FIG. 1). Referring to FIG. 3, both the upper support block 10 and the lower support block 12 have a slot 26 which has been cut or otherwise formed in the support block for reception of the root 27 of each tooth. Each tooth protrudes from the slot 26 toward the center of the mounting cavity. In addition, tooth 14 is connected and held in a separated spatial relationship at each longitudinal end to the bottom tooth 15 by mounting tooth 17 on one end of the shelf and mounting tooth 16 on the other end of the shelf. The COnstruction of the shelf in the manner just described is significant because it facilitates ease of construction and mass production of the basic shelf structure. It is substantially easier to rout a slot 26 and then glue a mounting tooth 14 into the slot than it is to form the support block with a mounting tooth protruding from the support block.

As can be seen from FIG. 3, the support block at the edge of the block opposite from face 22 has a notch 28 formed or cut therein to receive the bender board 13. The depth of the notch is the same as the thickness of the bender board so that the facing surface of the shelf will be smooth. The bender board is a continuous board that is glued or otherwise attached into the support block 10 and support block 12 at notch 28 and provides a continuous support throughout the facing surface of the shelf.

As can be readily seen from the various illustrations of the invention, the shelf can be formed in practically any desired shape so long as the mounting surface is flat. The support block 10 and support block 12 can be cut in multiple pieces with a band saw or the like. The outer edge 29 and outer edge 30 of the support block 10 and support block 12 may be cut in a variety of shapes that mirror each other and which will allow one to produce a shelf that is not only functional but is decorative as well. Once the support blocks have been cut, notches 28 are routed into outer edge 29 and outer edge 30, and slot 26 is formed in each support block. Each tooth is then placed into the slot 26, the longitudinal ends of each tooth are connected and are spaced apart by mounting tooth 16 and mounting tooth 17 to form the mounting cavity of the shelf. Next, the bender board is secured in the notch 28. The entire shelf structure, once assembled, can be painted in a lacquer type finish to produce a product that is both functional and a work of art. Alternative surface treatments include veneer, decoupage, marbleizing, and the like. Normally, the upper support block 10 has a primary surface 31 and the lower support block 12 has a secondary surface 32 with the surface 31 being in a plane and parallel to the secondary surface 32. Primary surface 31 and secondary surface 32 may be covered with optional veneer 33 which would be connected to the optional veneer 25 to provide a shelf that has a natural wood appearance.

The slot 26 is spaced from face 20 and face 22 to facilitate mounting of the shelf on a vertical wall or other support structure.

Figure 4:
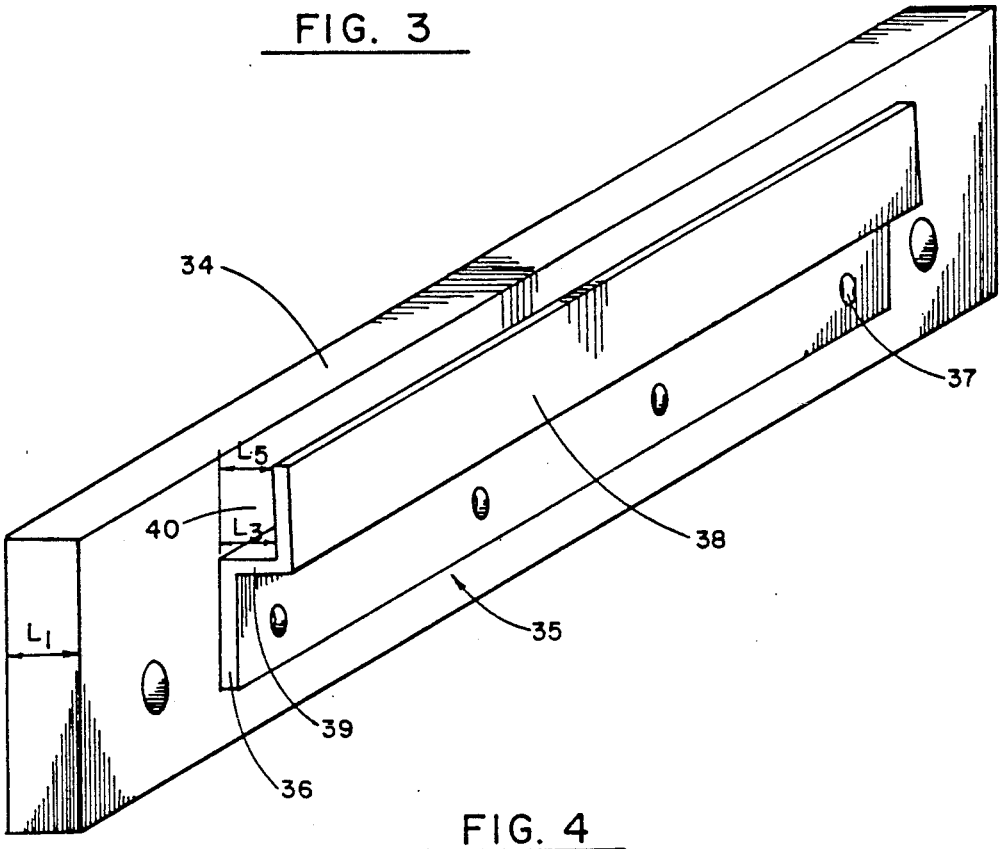
FIG. 4 shows a prospective of the wall bracket.

As can be seen from FIG. 3 and FIG. 4, the mounting bracket for this shelf includes a mounting board 34 and a support plate 35. The support plate 3S has a elongated base 36 which is connected to the mounting 34 by screws 37. The elongated base 36 is connected to a support arm 38 by an offset 39 thus creating a channel 40 between the support arm 38 and the mounting board 34. The distance L1 which is the thickness of the mounting board 34 is the same as the distance L2 which is the distance from the face 20 and face 22 of the support blocks to the wall of the slot nearest the face 20 and face 22.

As can be seen from FIG. 4, the support arm 38 is biased or angled at an approximately 2 degrees toward the mounting board and the distance L3 at the base of the channel 40 is the same as the thickness L4 of each tooth. Thus, the distance L5 will be slightly less than the width of each tooth so that the tooth, once forced into the channel 40 will be snugly secured within the channel to fixedly attach the shelf to the wall. The angle of the support arm 38 being biased in the direction of the mounting board will tend to force the support block 10 firmly against the wall 41 once the mounting bracket has been attached to the wall by screws or other convenient means. In this particular case, the mounting bracket will normally be attached to the wall by passing the screws through the wall and pulling the same tight against the wall with a convenient structure such as those connectors known and referred to as "molly bolts" or the like. The mounting board 34 is made of wood while the support plate 35 is made of metal. The heights of the mounting board 34 is generally the same as the distance between the tips of the teeth. By constructing the mounting board 34 of wood, it will not dig into the wall board as readily as would a mounting board made of metal. Likewise, the support plate 35, made of metal, will hold firmly to the wooden mounting board. Constructing the mounting board of the maximum permissib¹ᵉ height, there is more contact between the board and the wall, thus reinforcing the connection. In practice, this invention creates a rigid connection with the shelf to the wall and the shelf can have substantial load bearing capacity without flexing or tipping forward because of the pressure on the cantilever structure.

Figure 5:
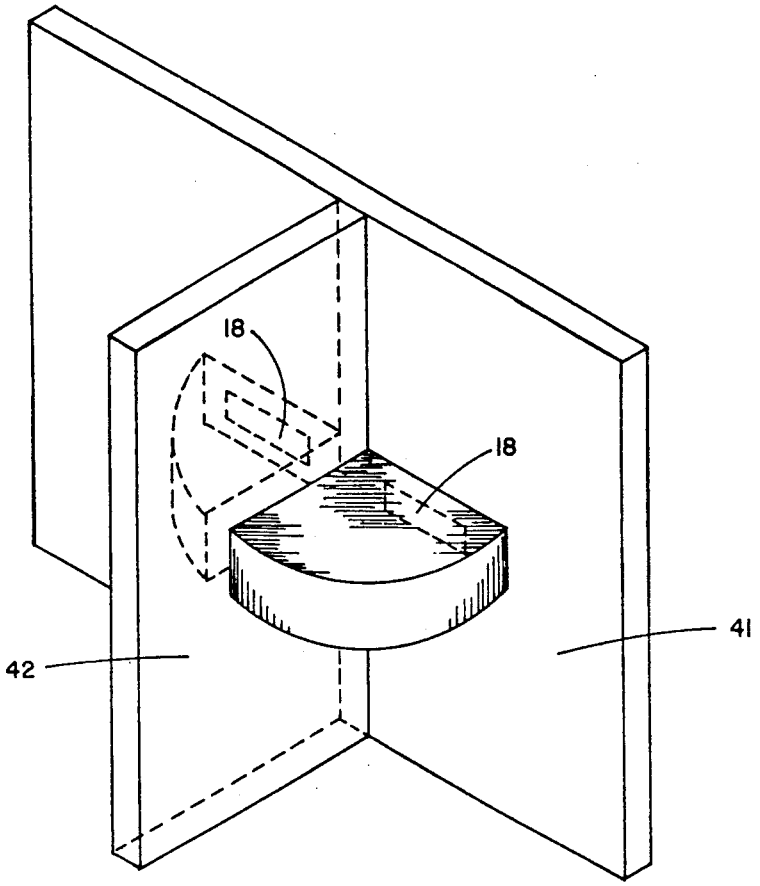
FIG. 5 shows a view of a pie-shaped shelf mounted on opposite sides of a wing wall.
Figure 6:
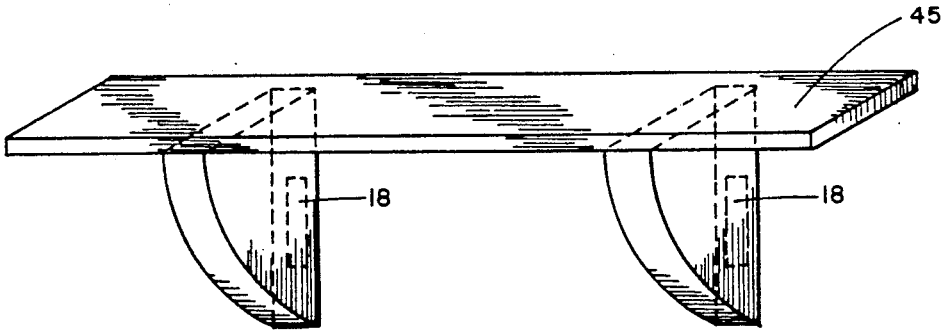
FIG. 6 shows the same pie-shaped shelf unit mounted in a 90 degree rotation as compared to the mounting shown in FIG. 5, with the shelves serving as brackets for a second shelf.
Figure 7:
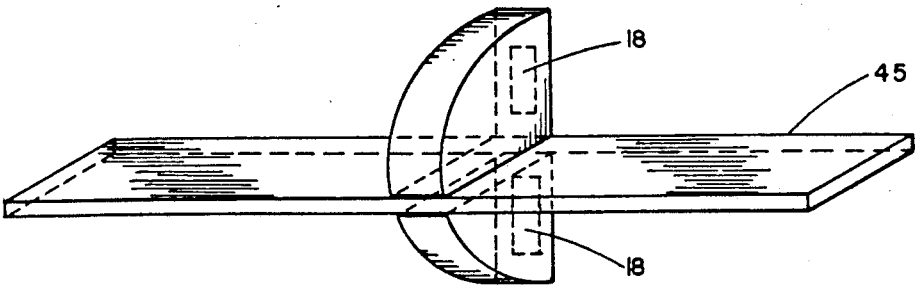
FIG. 7 shows yet another orientation of the pie-shaped shelves in conjunction with a larger shelf unit.

The utility of this invention can be clearly seen from FIG. 5, FIG. 6, and FIG. 7. In FIG. 5, FIG. 6, FIG. 7, the alternative uses of the shelf of this invention are illustrated. In FIG. 5, a pie-shaped shelf is shown mounted to a wall and spaced on each side of a wing wall. If the wing wall is of a metal or is otherwise not receptive to the attachment of a mounting bracket, by having a tooth on both the top and bottom sides of the shelf, it is convenient to mount the shelf on opposite sides of the wing wall by simply rotating the orientation of the shelf by 180 degrees.

Figure 8:
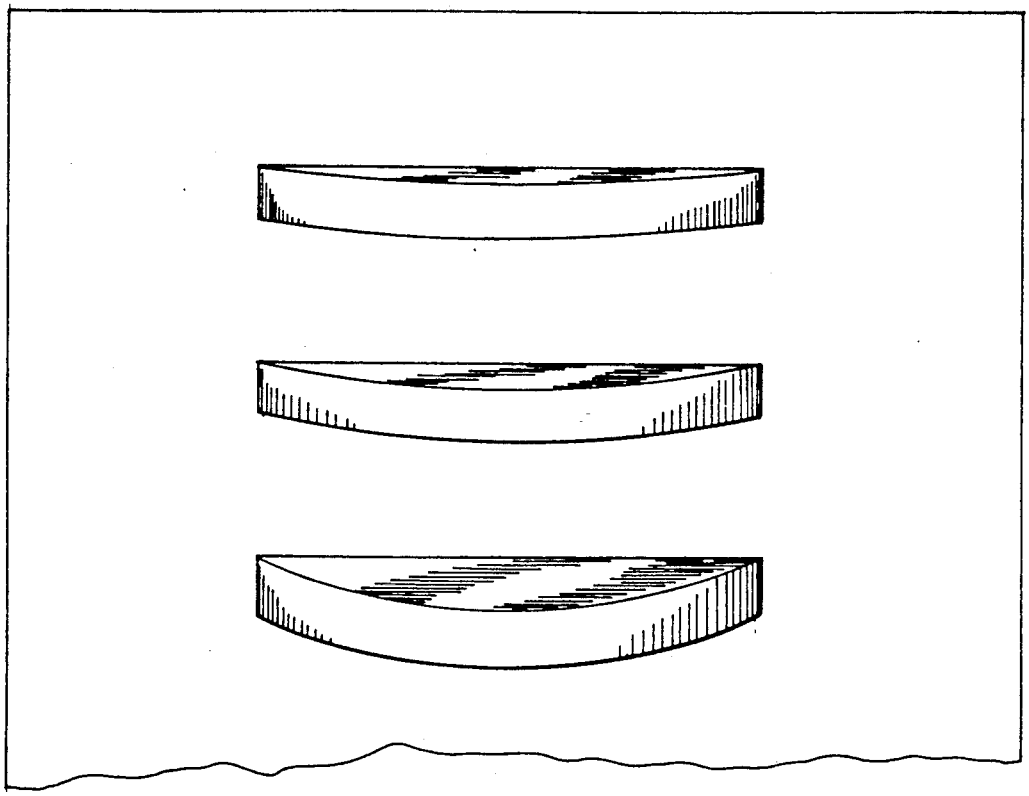
FIG. 8 shows a variation of the pie-shaped shelf with three of the shelves mounted in a stacked relationship displaying artifacts.
Figure 9:
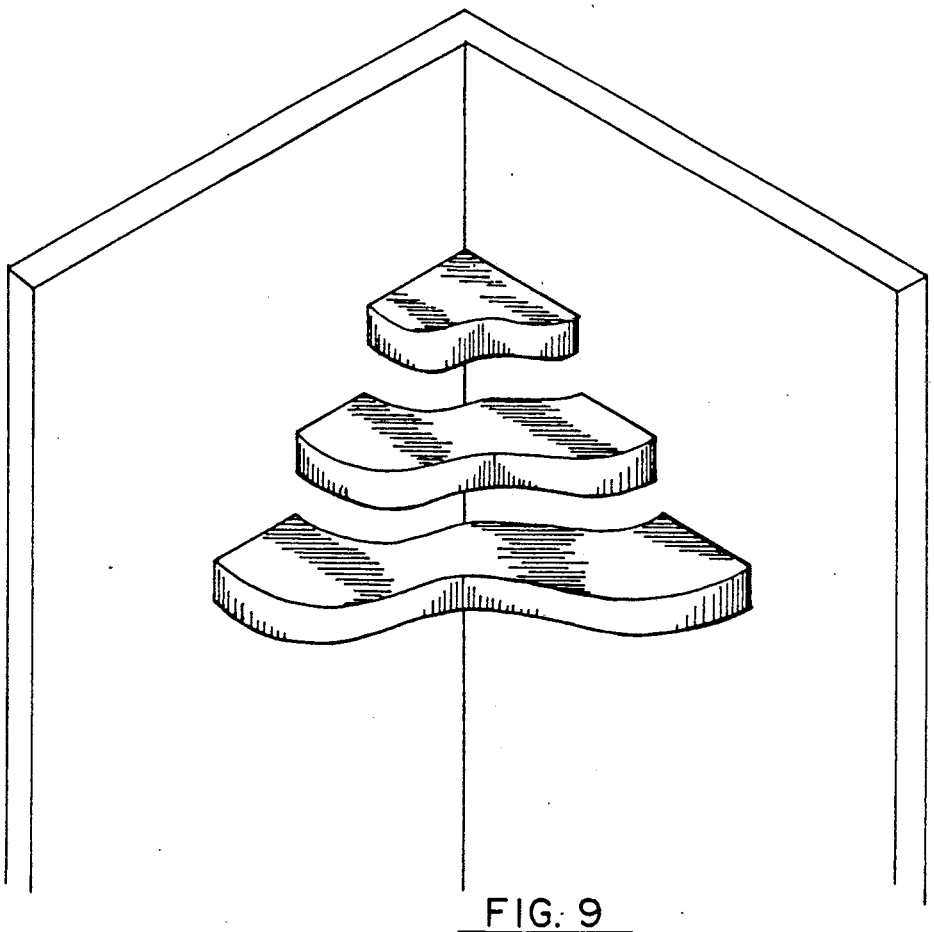
FIG. 9 shows yet another variation of the shelf units mounted in relationship with each other.

Alternatively, as can be seen from FIG. 6, the shelf may itself be a bracket for a larger shelf. In this case, the shelf has been rotated 90 degrees from its position as shown FIG. 1 and FIG. 5, thus providing a flat surface on which to set a shelf 45. FIG. 8 shows a shelf 45 located between two shelves which have been oriented in an up and down direction to give an appearance that the shelf 45 is being held in a sandwich position between the two pie-shaped shelves. The pie-shaped shelf could be in a variety of configuration as can be readily seen from FIG. 8 and FIG. 9.

One aspect of this invention that is particularly useful is the ability to shift the shelves laterally once they have been mounted and without the necessity of having to remove the shelves and relocate the mounting structure. As can be seen from FIG. 8, when shelves are stacked in a vertical relationship for purposes of display, it would be desirable to have them for purposes of display in a predetermined spatial relationship. Often time it is difficult to connect the mounting structure in a fashion to get these shelves in the exact alignment that is desired. However, with the present invention, because the mounting bracket is of a length substantially shorter than the length of the tooth, once the shelves are mounted on the bracket, they can be shifted from side to side in order to create the proper alignment.

It is also important to the structure of this invention that the support plate 35 in the preferred embodiment be metal which can be bent with pliers along its length to accommodate for irregularities in the wall. In addition, with the support plate 3$ being metal and each tooth 14 being wood, there is a decrease in the expansion and contraction that occurs with changes in the temperature and humidity thus allowing the shelves to be easily placed and removed from the mounting bracket so that the shelves can be interchanged easily for display purposes. As will be noted from FIG. 2, the edge of each tooth toward the center of the mounting cavity is cut at an angle shown by reference numeral 46. This will facilitate the tooth slipping into the channel 40 when the shelf is attached to the mounting bracket. The cut or bevel allows the tooth to slip into the narrowed opening L5 and yet the biased support arm 38 will continue to press the tooth, and thus the shelf against the wall 41.

Having described a preferred embodiment of my invention, I claim:

1. A new and improved shelf and shelf mounting combination including:

a shelf having an upper support block and a lower support block;

the upper support block having a top surface and the lower support block having a bottom surface generally parallel to the top surface;

means creating a facing surface;

means creating a mounting cavity;

the upper support block and the lower support block being connected and spaced apart by the means creating a facing surface and the means creating a mounting cavity;

the support blocks having faces forming a mounting surface;

an elongated tooth protruding from the upper support block into the mounting cavity and an elongated tooth protruding from, the lower support block into the mounting cavity, said elongated teeth being connected to each other at their longitudinal ends by mounting teeth;

the teeth being spaced inwardly of the mounting cavity from the mounting surface;

the teeth being generally uniform in cross-section;

a mounting bracket to be mounted on a wall including a mounting base and a support arm connected thereto by an offset creating a longitudinal channel having a cross-section substantially similar to the cross-section of the teeth, said channel having an opening at one end and a closed base at the other end and said channel being narrower at said opening than at said base to cause the support arm to bias the shelf in the direction of the mounting base;

the upper surface and the lower surface having their edges in flush continuous contact with the wall when the mounting bracket, is mounted on a wall and the shelf is attached thereto with one of the elongated fitted within the channel.

2. A new and improved shelf and shelf mounting structure as described in claim 1, wherein the facing surface covers the entire face of the shelf and the ends of the facing surface area are in flush, continuous contact with the wall.

3. A new and improved shelf and shelf mounting structure as described in claim 1, wherein the height of the mounting base is substantially equal to the distance between the tips of the teeth protruding into the mounting cavity.

4. A new and improved shelf and shelf mounting structure as described in claim 1, wherein the mounting base is wood and the support arm is metal.

5. A new and improved shelf and shelf mounting structure as described in claim 1, wherein the length of the mounting base is substantially shorter than the length of the teeth.

6. A new and improved shelf and shelf mounting structure as described in claim I, wherein the top surface, the bottom surface, and the facing surface totally hide the mounting structure when the shelf is mounted on a wall.

7. A new and improved shelf and shelf mounting structure as described in claim 1, wherein the tooth has a beveled edge.

8. A new and improved shelf and shelf mounting structure as described in claim 1, wherein the shape of the upper support block is the same as the shape of the lower support block.

9. A new and improved shelf and shelf mounting structure as described in claim wherein the upper support block is spaced from the lower support block by a distance of a minimum of two inches.

10. A new and improved shelf and shelf mounting structure as described in claim 1, wherein the outer edge of each support block has a notch formed therein with the facing surface fit within the notch.

11. A new and improved shelf and shelf mounting structure as described in claim 1, wherein the upper support block and lower support block have a slot formed therein with a tooth being mounted in each slot.

* * * * *